United States Patent [19]

Preston

[11] 4,129,197

[45] Dec. 12, 1978

[54] SAFETY-CATCH SCAFFOLDING SYSTEM

[76] Inventor: John C. Preston, 18 Dunlop St., North Parramatta, N.S.W., 2151, Australia

[21] Appl. No.: 765,391

[22] Filed: Feb. 3, 1977

[30] Foreign Application Priority Data

Aug. 13, 1975 [AU] Australia ..... 16852/75

[51] Int. Cl.[2] ..... E04G 3/14; E04G 5/04

[52] U.S. Cl. ..... 182/82; 182/112; 182/138

[58] Field of Search ..... 182/82, 137, 112, 113; 256/DIG. 6, 73; 52/235, DIG. 12

[56] References Cited

U.S. PATENT DOCUMENTS

| | | | |
|---|---|---|---|
| 2,434,447 | 1/1948 | Horn | 256/73 |
| 3,480,069 | 11/1969 | Handwerker | 52/DIG. 12 |
| 3,762,110 | 10/1973 | Boss | 52/63 |
| 3,881,699 | 5/1975 | Nusbaum | 182/82 |

*Primary Examiner*—Reinaldo P. Machad

*Attorney, Agent, or Firm*—Stevens, Davis, Miller & Mosher

[57] ABSTRACT

An adjustable scaffolding system adaptable to the progressive growth of a building during construction has a series of spaced uprights, each having a plurality of vertically disposed slots for the sliding engagement of the edges of a plurality of frames. The frames and a third slot on the uprights engage fastening means protruding beyond the edge of a floor slab of the building.

7 Claims, 5 Drawing Figures

FIG. 2.
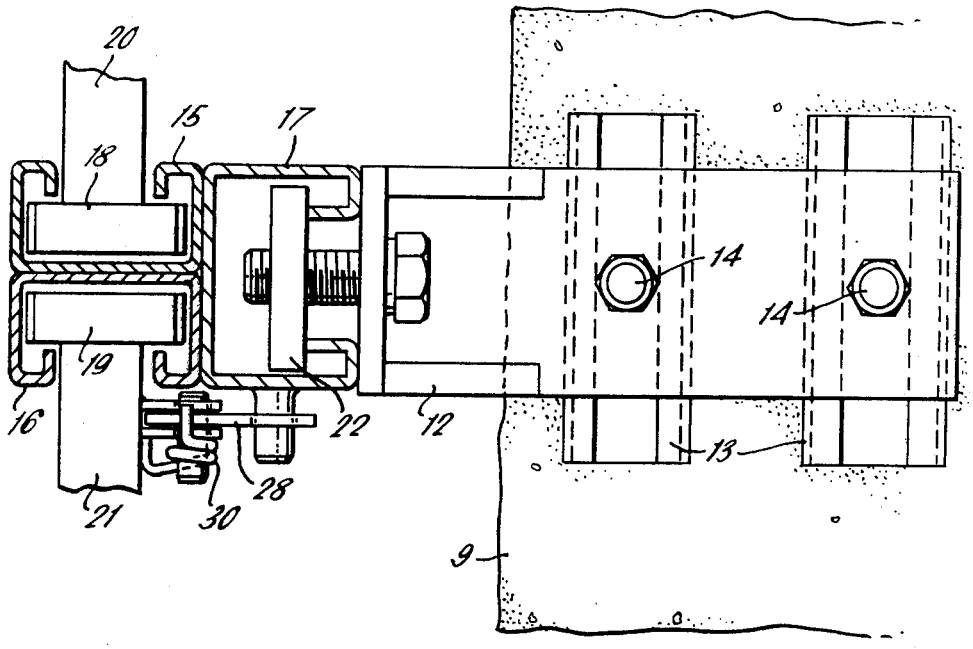
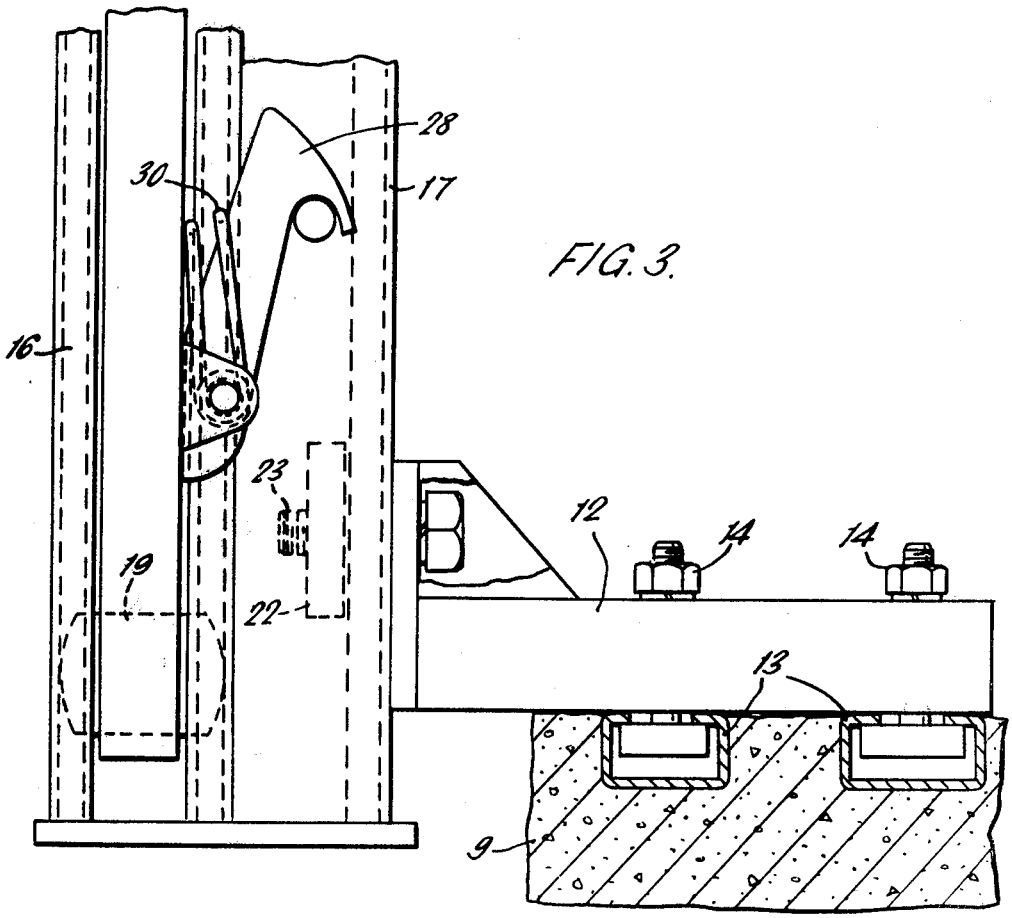
FIG. 3.

SAFETY-CATCH SCAFFOLDING SYSTEM

This invention relates to scaffolding, and more particularly to an adjustable scaffolding system which is readily adaptable to the progressive growth of a building during construction thereof. It is known to provide demountable scaffolding systems for this purpose, but such systems have suffered from the disadvantage that the components thereof must be assembled laboriously at each stage of construction, by bolting or otherwise fastening the assembly, and then subsequently dismantled in a reverse manner as, for example, the successive slab floors of a building are proliferated one above the other.

It is an object of the present invention to overcome the above and other disadvantages and to provide an adjustable system wherein the principal components are relatively movable by a simple sliding action, and are capable of being temporarily and rapidly immobilized by means of an arrangement of built-in safety catches which operate automatically when brought into use, but which are easily overridden when further adjustment of the system is required.

According to the invention therefore, in one of its aspects, a scaffolding system comprises, in combination, a series of spaced upright standards each having a plurality of vertically disposed slots or open faces therein communicating with the interior of the standard, two such outwardly and oppositely directed slots in each said standard being adapted for the sliding engagement therein of the edges of frames which extend between the standards, and a third such slot being adapted for the sliding engagement therein of fastening means near the end of a cantilever protruding beyond the edge of a floor slab of a building to be protected by the interposing of said frames in the spaces between adjacent standards, so as to extend above and beyond a formed floor.

Figure 1:
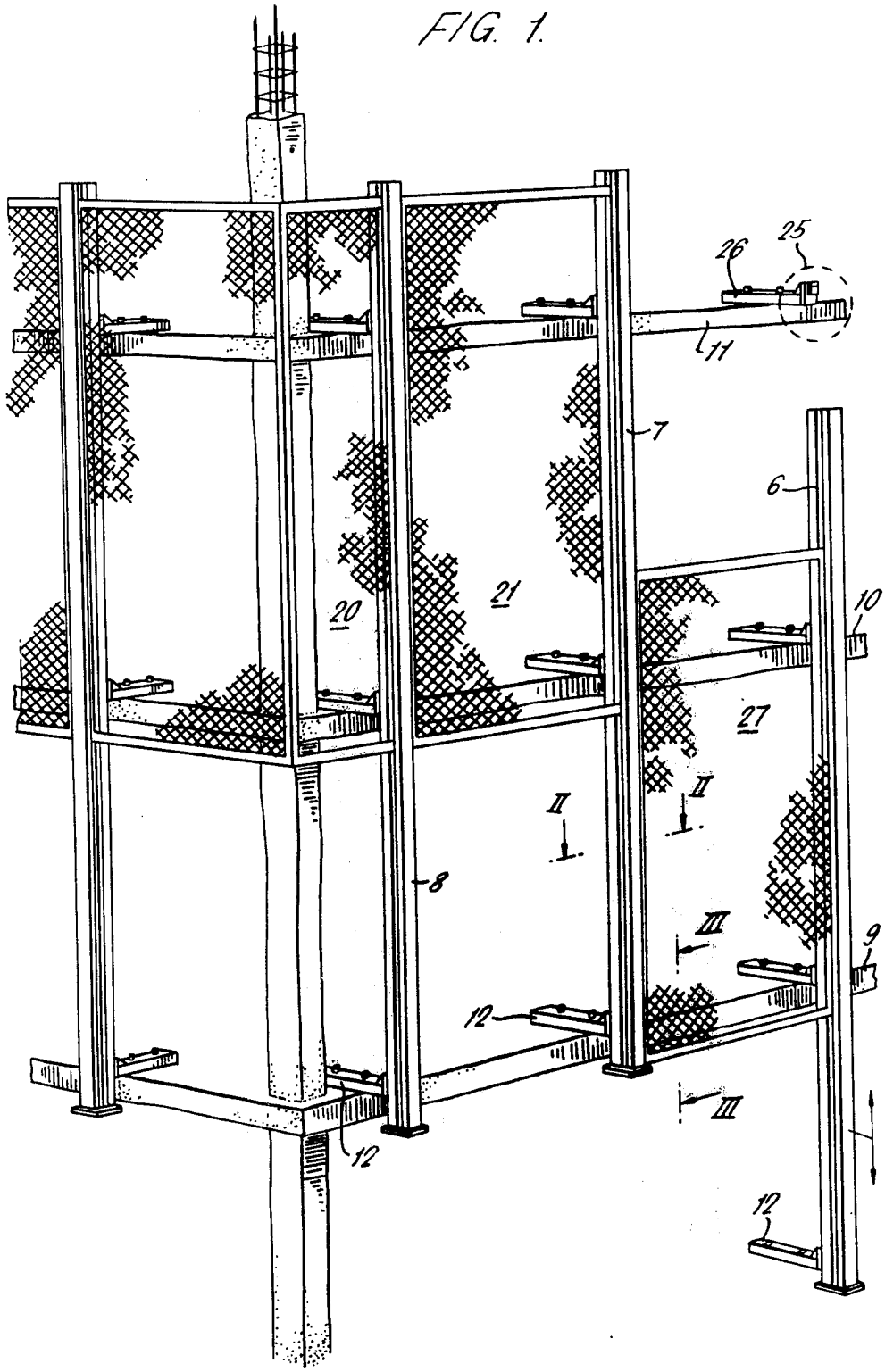
Figure 4:
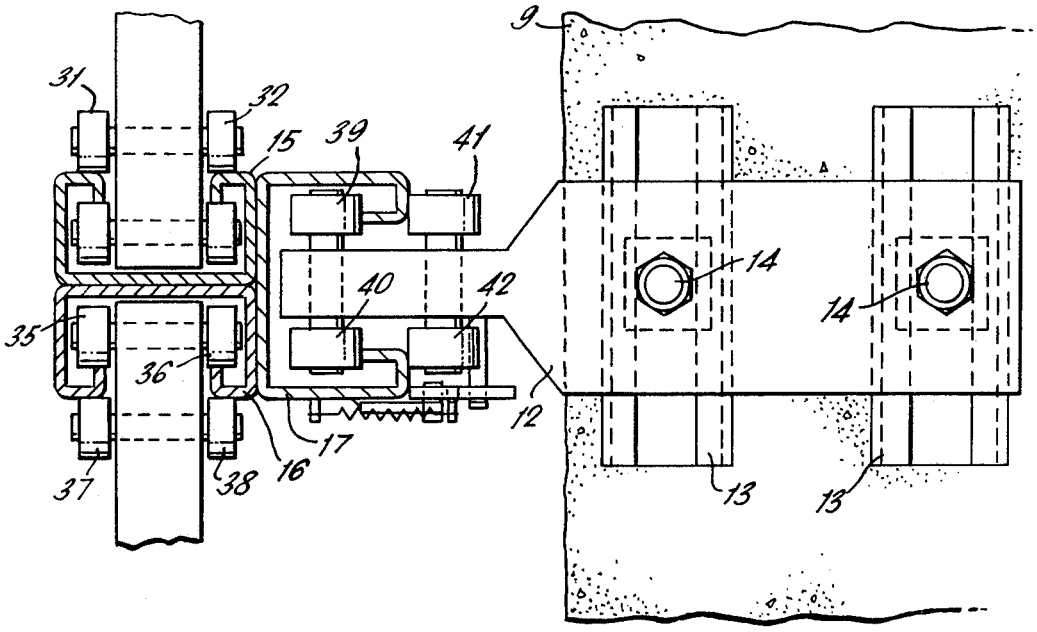
Figure 5:
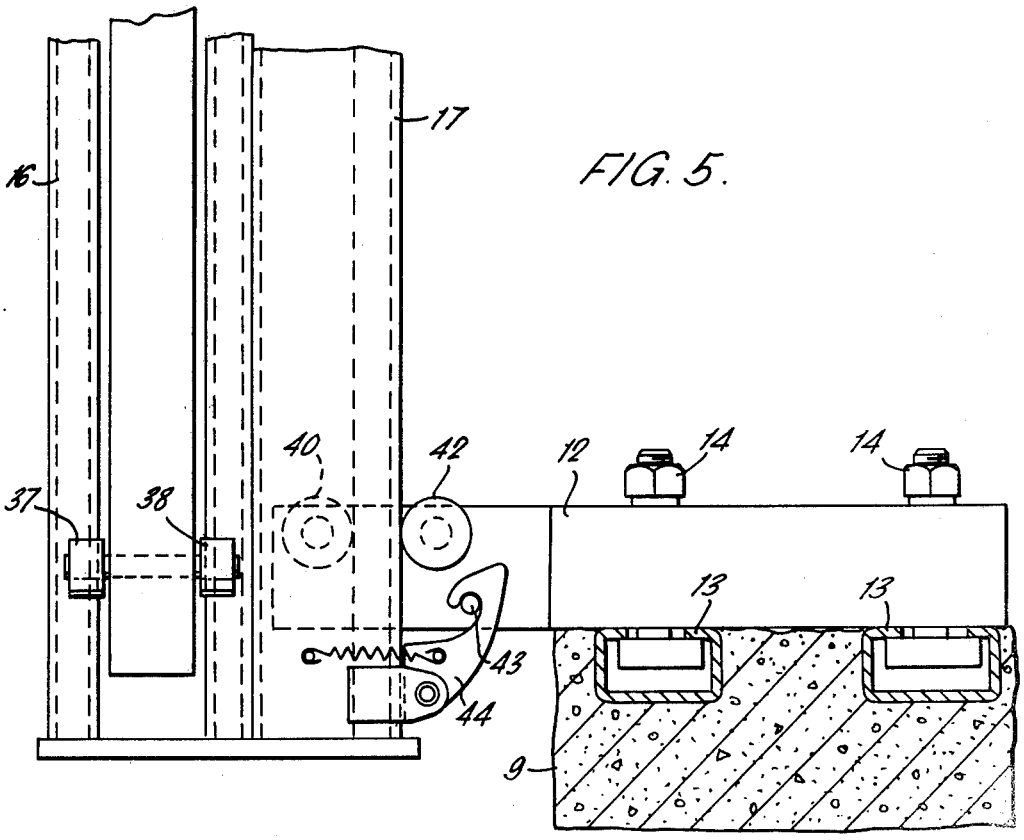

One embodiment of the invention defined in the preceding paragraph will now be described herein with reference to the accompanying drawings in which:

FIG. 1 shows, in perspective view, a scaffolding system wherein one said frame remains at one floor level while the remainder of said frames have been elevated to protect the next floor above, FIG. 2 shows, in plan view, along the line II—II of FIG. 1, the connection means between frames and standard and cantilever, FIG. 3 shows, in side elevation along the line III—III, the apparatus of FIG. 2 and, FIGS. 4 and 5 show, in plan and elevation respectively, a modification of the apparatus of FIGS. 2 and 3.

Upon referring to the drawings, and assuming that at least one slab floor has been formed in a building, it will be seen that a series of said standards such as 6, 7 and 8 has been erected along the edges of slabs such as 9, 10 and 11 at intervals of say 8 feet. Said standards, each of which has a height approximately equal to twice the height between prospective floors, are fastened by said fastening means at the outer ends of a series of said cantilevers such as 12 whose inner ends are attached within the open mouths of a number of respective channel sections such as 13, which have previously been embedded within the concrete of the floor slab 9 just completed, so that the upper mouths of said channel sections lie flush with the upper surface of said floor, and permit the installation therein of bolt devices 14 which are also secured to the inner ends of said cantilevers. Each said bolt device may for example, be that marketed under the Trade Mark UNISTRUT or may be some equivalent device.

Each said standard may be composed of three box-shaped channel sections, two of which, 15 and 16, are fastened together by welding or otherwise, back to back, to leave the open mouthed sides thereof disposed laterally in opposite senses in the plane of the outer wall of the building, while the third channel section 17 is fastened similarly with its back attached to two sides of the first mentioned channel sections 15 and 16 so that the mouth of the third channel section 17 faces inwardly towards said building substantially at right angles to the plane of the wall. Into the laterally facing mouths of 15 and 16 the ends 18 and 19 of respective frames 20 and 21 are introduced, each said end being upset so as to prevent its removal from the interior of the channel section. For this purpose the upset end is conveniently installed in the channel endwise from above. Similarly the fastening means such as the nut 22 which is rigidly attached to the end of each cantilever such as 12 may be introduced into its respective channel section from above, so that said nut, which engages an axial bolt 23, is retained within the channel 17 and may be removably fastened with respect to the open face by tightening in known manner. In each said channel section a re-entrant lip is provided with or without an inwardly turned land thereon.

Assuming now that a completed floor having a series of spaced standards therealong is protected by an interposed series of frames located slidably between each adjacent pair of standards, preparation for construction of the next floor above, and for the protection of persons constructing form-work to make said floor, may be provided by lifting said frames in succession so that they slide upwards within the side channels in the respective standards until they uncover the aperture previously protected, and cover instead a region extending somewhat above the level of the next floor to be formed. That is to say, each frame which previously extended throughout the lower half of the height of each standard now extends throughout the upper half of each standard and extends to the upper extremity thereof.

After construction of the next set of form-work and after the pouring of the next floor above with the aid of said form-work, the individual elements of each standard (such as 6) in turn may then be slackened off and/or dismantled so that the lower half of each standard is slid or removed from its associated cantilever such as 24 and is re-engaged or re-erected again above its own erstwhile upper half of attachment at the region 25 to the next available cantilever 26 in the floor slab 11 which has just been completed. Thus the next series of upward sliding movements of said frames (such as the frame 27) may follow in a succession of operations provided that a pair of cantilevers for each frame is always provided ahead for the next "half" standard. This is to say, of a set of three pairs of cantilevers, two are always installed and the third is always loose, said pairs being rotated throughout their application.

The means for immobilizing the frames successively with respect to each respective pair of standards comprise at least two pawls such as 28 disposed respectively on opposite sides of each frame, preferably with two said pawls at each side thereof near the top and bottom of the frame respectively. Said pawls are adapted to engage suitable laterally protruding pegs 29 attached to or forming part of the standards. The pawls are so shaped and located that when the frames are raised as above described through a distance equal to their own height, each pawl engages its respective peg and clicks into position behind it in such a manner that the frame is held and secured against falling, and will hang safely after being released. Preferably, each pawl is suitably spring-loaded in known manner towards the engagement position, for example, by means of the spring 30.

As each finished floor has its associated cantilevers detached from the standards, the latter having been removed to a greater height as above described, the inner end of each said cantilever is detached from the associated embedded channel, which in each case is approximately 6 inches in length and is installed at intervals of approximately 8 feet along the slab edge to correspond with the respective standards. Upon removing the bolts such as 14 from the channel mouths, the latter may then be used to receive suitable pillars or upright members to which a hand-rail (not shown) may be attached by welding or otherwise after stringing it along a succession of such pillars, thereby providing a sufficient degree of protection to persons moving about on a finished floor. The removed cantilevers, and their fastening means, are then available for use on the next floor to be formed, in which of course further similar channel sections such as 13 must be embedded during construction. After final completion of the floor-building activities all said hand-rails and their supporting pillars may be removed, and the unwanted open mouths of the embedded channels filled in with concrete flush with the top surface of each finished floor.

Preferably, to reduce unwanted friction, as in the embodiment of the invention shown in FIGS. 4 and 5, a pair of bogey-wheels such as 31, 32 and 33, 34 and also 35, 36 and 37, 38, may be located just inside and also just outside each mouth of the respective channel sections 15 and 16 of the standards. Said bogeys may thus permit the (effective) upset ends of the frames and standards in each case to slide easily to aid the manual or other lifting of the frames, and the design of said bogeys may be such that the use of lubricants is not necessary. Similar pairs of bogeys 39, 40 and 41, 42, may be used to engage the cantilever 12 with the channel section 17.

The frames may be constructed from, say, ¾ inch square metal pipe covered with a material such as bird wire in the interests of lightness, visibility therethrough, and also the reduction of wind load thereon. Thus the lifting of the frames may be a simple one-man operation, especially if the above described bogeys are employed upon the upset ends.

Preferably also a system for engagement of a pawl such as 43 with a peg such as 44 is employed between the cantilevers and the standards, in addition to the use thereof between the frames and the standards, thus dispensing with the necessity for bolting and unbolting of said fastening means prior to each re-adjustment of the relative positions of the various half-sections of the standards above described.

The arbitrary selection of 8-foot lengths for the frames has been made to facilitate the transport of the dismantled scaffolding system on trucks or the like.

It will be seen that the invention provides a protection system which adequately prevents the danger of personnel or articles falling from a building of the slab floor type during construction thereof, and said system is simple to operate and inherently safe while dispensing with the need to expend labor wastefully upon the large number of fastenings of conventional type normally employed in scaffolding systems.

The claims defining the invention are as follows:

I claim:

1. A scaffolding system comprising, in combination, a plurality of frames, a series of spaced upright standards each having a plurality of vertically disposed slots or open faces therein communicating with the interior of the standard, two such outwardly and oppositely directed slots in each said standard being adapted for the sliding engagement therein of the edges of said frames which extend between the standards, and a third such slot being adapted for the sliding engagement therein of fastening means near the end of a cantilever protruding beyond the edge of a floor slab of a building to be protected by the interposing of said frames in the spaces between adjacent standards, so as to extend above and beyond a formed floor, quick detachable means connecting said frames to said standards at vertically spaced intervals.

2. A scaffolding system as claimed in claim 1, wherein the length of each said standard is approximately twice the height between an adjacent pair of said floor slabs.

3. A scaffolding system as claimed in claim 2, wherein each said standard is demountable to thereby permit removal of the lower half thereof for subsequent relocation above and in alignment with the erstwhile upper half thereof by attachment to the fastening means of a further one of said cantilevers protruding beyond the edge of the next floor slab above that to which said upper half is attached.

4. A scaffolding system as claimed in claim 3, wherein each said half of each said standard is adapted to be immobilised removably with respect to an associated cantilever by the engagement of a pair of pawls located at the sides of said half of each said standard with a respective pair of pegs protruding from said cantilevers.

5. A scaffolding system as claimed in claim 1, in which said quick detachable means comprises a pair of pawls located at the sides of said frames, pair of pegs protruding from said standards, each said pawl being so shaped and positioned that it engages its associated peg automatically upon the raising of said frame and then depends therefrom upon the relinquishment of a lifting force applied to said frame, but is again disengaged therefrom upon continuation of the application of said lifting force.

6. A scaffolding system as claimed in claim 5, wherein each said pawl is Spring-loaded towards an engaged position with respect to its associated peg.

7. A scaffolding system as claimed in claim 1, wherein the sliding engagement between said frames and said standards, is effected via pairs of bogey wheels located athwart inner and outer surfaces of respective mouths of said slots.

* * * * *